US011781338B2

(12) United States Patent
Hawthornthwaite

(10) Patent No.: US 11,781,338 B2
(45) Date of Patent: Oct. 10, 2023

(54) FENCE BRACKET AND FENCE BRACKET SYSTEM

(71) Applicant: SHPB Ltd, Ryton On Dunsmore (GB)

(72) Inventor: Steven Roy Hawthornthwaite, Ryton On Dunsmore (GB)

(73) Assignee: SHPB Ltd, Ryton on Dunsmore (GB)

( * ) Notice: Subject to any disclaimer, the term of this patent is extended or adjusted under 35 U.S.C. 154(b) by 0 days.

(21) Appl. No.: 17/900,154

(22) Filed: Aug. 31, 2022

(65) Prior Publication Data

US 2023/0250673 A1 Aug. 10, 2023

Related U.S. Application Data

(63) Continuation of application No. 17/890,169, filed on Aug. 17, 2022.

(30) Foreign Application Priority Data

Feb. 4, 2022 (GB) ..... 2201487

(51) Int. Cl.

| | |
|---|---|
| ***E04H 17/22*** | (2006.01) |
| ***E04H 17/20*** | (2006.01) |
| ***E04H 17/18*** | (2006.01) |
| ***E04H 17/16*** | (2006.01) |

(52) U.S. Cl.

CPC ..... *E04H 17/22* (2013.01); *E04H 17/163* (2013.01); *E04H 17/18* (2013.01); *E04H 17/23* (2021.01)

(58) Field of Classification Search

CPC ..... E04H 17/20; E04H 17/22; E04H 17/23; E04H 17/009; E04H 17/18; E04H 17/185; E04H 17/16; E04H 17/161; E04H 17/163; E04H 12/22; E04H 12/2207; E04H 12/2215; E04H 12/2223; E04H 12/223; E04H 12/2238; E04H 12/2253; E04H 12/2261; E04H 12/2269

See application file for complete search history.

(56) References Cited

U.S. PATENT DOCUMENTS 6,151,852 A * 11/2000 Linn ..... E04H 17/163 52/745.1
7,338,033 B2 * 3/2008 Anson ..... E01F 9/692 256/65.01
7,461,493 B2 * 12/2008 Quertelet ..... B21D 53/40 52/712

(Continued)

FOREIGN PATENT DOCUMENTS

CA 2307146 A1 * 11/2001 ..... E04H 17/18
DE 202007019635 U1 * 10/2014 ..... E04G 21/3223

(Continued)

*Primary Examiner* — Jonathan P Masinick
(74) *Attorney, Agent, or Firm* — Reichel Stohry Dean LLP; Mark C. Reichel; Natalie J. Dean

(57) ABSTRACT

A fence bracket (10), a fence bracket system, a kit of parts, a fence assembly and a method of manufacturing a fence bracket are described. The fence bracket (10) is suitable for use with a fence panel. The fence bracket has a body (12) having a base (14), a front wall (20), a first side wall (16) and a second side wall (18); and a support (22). The support (22) is provided on the front wall (20). The support (22) is configured to connect to a fence post. The front wall (20) has a region comprising an aperture (30) suitable for receiving an ancillary component (70).

19 Claims, 8 Drawing Sheets

(56) References Cited

U.S. PATENT DOCUMENTS

| | | | | |
|---|---|---|---|---|
| 8,424,851 | B2 * | 4/2013 | Christoffer | E01F 13/022 256/65.14 |
| 8,925,904 | B2 * | 1/2015 | Christoffer | E04G 21/3223 182/113 |
| 9,863,162 | B2 * | 1/2018 | Whiteley | E01F 9/692 |
| 11,111,694 | B2 * | 9/2021 | Nickelston | E04H 17/20 |
| 11,371,258 | B2 * | 6/2022 | Goodin | E04H 12/2238 |
| 11,479,937 | B2 * | 10/2022 | Guindi | E04H 12/2269 |
| 2008/0006808 | A1 * | 1/2008 | Thompson | E04H 17/24 256/45 |
| 2014/0138511 | A1 * | 5/2014 | Howe | E04H 12/2261 248/507 |

FOREIGN PATENT DOCUMENTS

| | | | | | |
|---|---|---|---|---|---|
| GB | 2322877 | A | * | 9/1998 | E04H 12/2215 |
| GB | 2458312 | A | * | 9/2009 | E04H 12/2215 |
| GB | 2527857 | A | * | 1/2016 | E01F 13/022 |
| GB | 2571771 | A | * | 9/2019 | E04H 12/2223 |

* cited by examiner

FENCE BRACKET AND FENCE BRACKET SYSTEM

PRIORITY

The present application is related to, claims the priority benefit of, and is a U.S. continuation patent application of, U.S. patent application Ser. No. 17/890,169, filed Aug. 17, 2022, which is related to, and claims the priority benefit of, Great Britain patent application serial no. GB2201487.2, filed Feb. 4, 2022. The contents of each of these applications are incorporated herein directly and by reference in their entirety.

TECHNICAL FIELD

The present disclosure relates to a fence bracket. Particularly, but not exclusively, the disclosure relates to fence bracket, a fence bracket system, a kit of parts, a fence assembly and a method of manufacturing a fence bracket.

BACKGROUND

Temporary and semi-permanent fencing may be used in a variety of applications where a barrier is to be erected to cordon off or prevent access to an area. For example, open air music festivals often erect temporary fencing to prevent unauthorised access to the festival site. Other examples of uses of temporary fencing is to restrict access to potentially hazardous areas such as building sites.

An erected temporary fencing system therefore has a "restricted" side (within the fenced off area) and a "public" side (the area outside the fenced area).

One of the most common types of fences used for temporary fencing is the Heras™ fence. This type of fencing comprises a wire mesh panel attached to metal tube frame. The metal tube frame has two posts on which the fence panel stands. The fence posts may be retained into rubber or concrete blocks in use. In use a first fence's post is retained in a hole in the block and a post of a second fence is retained in another hole of the block. As a result, a number of fence panels can be joined together to form a long chain of fences by using a number of blocks. The fence post may be a fence panel post or a gate panel post.

Such blocks in use extend either side of a fence. As such they may present a tripping hazard for the public walking past the fence on the "public" side of the fence. High-visibility (hi-vis) block casings are generally employed to aid a person seeing such blocks. However, it may still be difficult to see such blocks at night or where the member of the public suffers from vision impairment.

Similarly, fencing may often be erected on sites which abut pavement, roads or tarmacked areas or other such built upon areas. A building or development site in an inner-city location abutting pavement is an example of such a scenario as there may be an uneven ground surface. As blocks extend either side of a fence the fence assembly must be staggered back from the edge of the full area of the development such that any change in height between the pavement and the internal area of the development site does not negatively effect the fence. If a block is placed across pavement and lower ground of the development site then the fence assembly may be disposed at an angle increasing likelihood of tipping (especially under side loading from wind for example).

Further, such blocks tend to be heavy and bulky as they made from concrete. As regulations tend to limit the maximum weight that a person can lift unaided there is often the need for installation of blocks to be carried out by at least two installers.

Even with such heavy blocks there is the potential for the fence posts to topple over due to wind loading. Whilst the mesh in an individual fence panel has a small surface area, due to the number of panels in a fence system and the metal tubular frame it offers a significant cross-sectional area for wind loading.

Further, it is relatively easy to lift such fence panels out from blocks. It is also relatively easy to push or manoeuvre blocks as they are generally not fixed to the ground.

Moreover, blocks are placed on the ground requiring installers to often bend down to fix the blocks in place. Such bending can place strain on the installer's back potentially causing injury.

The present disclosure aims to improve on the fencing systems known in the art.

BRIEF SUMMARY

Aspects and embodiments of the invention provide a fence bracket, a fence bracket system, a fence assembly, a kit of parts and a method of manufacturing a fence bracket as claimed in the appended claims.

According to an aspect of the invention, there is provided a fence bracket. The fence bracket is suitable for use with a fence panel. The fence bracket comprises:

- a body having a base, a front wall, a first side wall and a second side wall; and
- a support;
- wherein the support is provided on the front wall; and
- the support is configured to connect to a fence post; and
- wherein the front wall has a region comprising an aperture suitable for receiving an ancillary component.

Advantageously the fence bracket comprises at least one sidewall. Preferably the fence bracket comprises two sidewalls. The sidewalls increase the strength of the fence bracket. The fence bracket may thereby withstand greater loads, which may be encountered due to high winds effecting a fence installed using the bracket, and thereby transferred through the bracket and/or other sources of adverse pressure on such a fence.

The slot allows for the connection of an ancillary component to the fence bracket. The ancillary component allows the arm or locking strap to be connected to the fence bracket which enables the fence to be locked together above the bracket. The aperture could also be used to connect a fence panel joining bracket to the fence bracket.

The provision of the support on the front wall of the bracket reduces the footprint of the fence bracket. The support being in front of the front wall (in use) means that the fence bracket does not extend onto the "public" side of the fence. As such the fence bracket presents less of a tripping hazard to the public.

The front wall acts as a barrier preventing someone reaching into the inner parts of the fence bracket located on the "restricted" side of the fence bracket in use.

Preferably the region comprises a tab extending from the front wall. The tab may be used to abut against a fence joining panel bracket between the top of the inline support tubes and the tab. Such an implementation could be used to lock the fence posts to the fence bracket to prevent unauthorised removal.

The tab may comprise a portion to attach an ancillary component.

The tab may extend away from the front wall towards the "public" side or away from the wall towards the "restricted" side or the tab may extend upwards from the front wall.

Preferably a portion of the tab is bent such that the portion extends substantially perpendicularly from the front wall. The tab is bent such that it preferably extends away from the wall approximately or substantially perpendicular.

Preferably the aperture is located on the tab. Locating the aperture on the tab makes it easier to connect ancillary components for an installer.

Preferably the base further comprises a portion suitable for receiving a ground penetrating member for fixing the fence bracket to soft ground. The ground penetrating member may be a ground screw. The ground penetrating member is used to fix the fence bracket to soft ground such as dirt.

Preferably the body further comprises an ancillary support connected to the base and/or front wall; wherein the ancillary support is suitable to receive an ancillary support component. The ancillary support is used to connect further ancillary components to the bracket such as further stabilizers, braces, flag poles, another fence, scaffold poles, or other suitable apparatus. The ancillary support is preferably welded to the base and front plate. Preferably the ancillary support is welded just below tab. Preferably the weld is two points on either side of the ancillary support. Preferably the weld is 25 mm on both sides of the tab.

Preferably the fence bracket further comprises at least one hole suitable for receiving an anchor bolt for fixing the fence bracket to hardstanding or hard ground. The fence bracket may be used on hard ground to fix a fence where a ground screw or ground penetrating member cannot be employed.

Preferably the base does not extend past:

the front wall or the support.

Advantageously, as the base doesn't extend into the "public" side of the fence. This reduces the likelihood of the public tripping up over the base plate when the bracket is in use. Optionally where a second support is used the base may not extend past the second support.

Preferably the fence bracket further comprises a second support provided on the front wall and wherein the second support is configured to connect to a fence post.

Preferably, the aperture has an axis (A1) that is coplanar with an axis (A2) of the first fence support and coplanar with an axis (A3) of the second fence support. The aperture being on the same plane of the axis of the support posts means that the arm or locking strap in use is almost vertical and flush with the fence panel siding. Having the arm vertical and flush makes it harder to get through a fence assembly in use as there is littler area to axis through the arm. Further it makes the fence panel joining bracket to fix to fence supports as the aperture will be in-line with the fence tubes.

The first and second supports are tubes suitable for receiving a fence post. The tubes surround and support a fence panel post. The posts are often the weakest portion of the fence panel and may be liable to damage due to loading on the fence. Receiving the fence posts in tubular supports reduces the likelihood of damage to fence posts.

Preferably the first and second supports are configured such that in use the fence posts are uncovered over a distance between the bottom of the first and second supports and the ground to enable said fence posts to be fastened together with a fastener. In use lifting the fence posts causes the fence panel joining bracket or fastener to abut the bottom of the supports preventing them from being lifted out of the fence bracket.

Preferably the top surface of the first and second fence post supports is below the tab such that in use the fence posts received by the first and second supports are uncovered enabling said fence posts to be fastened together with a fastener such that pulling upward engages the fastener with the tab preventing fence post removal. In use lifting the fence posts causes the fence panel joining bracket or fastener to abut the tab preventing them from being lifted out of the fence bracket.

According to another aspect a fence bracket system is provided. The fence bracket system comprising:

a fence bracket as described previously; and further comprising at least one an ancillary component.

Preferably the at least one ancillary component is at least one:

an arm; and/or a fastener and/or a levelling device.

The arm is preferably a locking strap.

Preferably, the fence bracket system further comprises an ancillary support component; wherein the component is one of:

a stabilizer; or a brace; or a camera pole; or a solar light; or a flag pole; or a fixtures.

Preferably the at least one ancillary component is an arm and wherein the arm comprises an aperture engaging portion disposed at one end of said arm configured to removably engage aperture of the bracket.

The arm in use can act as a further physical barrier between the "public" and "secure" sides of the fenced off area. The arm fits into the gap between the first and second fence panel preventing access by someone trying to fit their hand through. The arm is removably engageable with the fence bracket.

Preferably the arm further comprises an arm aperture disposed at a second end of said arm suitable for receiving a fastener. The fastener may be used to connect the arm to a fence panel and thus the fence panel to the bracket.

Preferably the at least one ancillary component further comprises a fastener.

According to a further aspect a kit of parts comprising the components of the fence bracket system of a previous aspect.

Preferably the kit of parts of claim further comprises at least one fence panel.

According to another aspect a fence assembly is provided. The fence assembly comprising:

a fence bracket system of a previous aspect;

at least one fence panel.

Alternatively, the fence assembly comprises:

a fence bracket system of a previous aspect;

at least one fence post.

According to another aspect a method of manufacturing a fence bracket is disclosed. The fence bracket comprising:

cutting a shape from a material sheet;

folding the shape to form a body comprising a base, a front wall a first side wall and a second side wall;

cutting an aperture into the material sheet;

connecting the front wall to the first and second side walls; and connecting a support to the body.

Preferably the cutting is made by laser cutting.

Preferably the method of manufacturing a fence bracket further comprises:

welding the support to the body.

Preferably the method of manufacturing a fence bracket further comprises:

forming a tab with the aperture disposed thereon.

BRIEF DESCRIPTION OF THE DRAWINGS

One or more embodiments of the invention will now be described, by way of example only, with reference to the accompanying drawings, in which.

Figure 1:
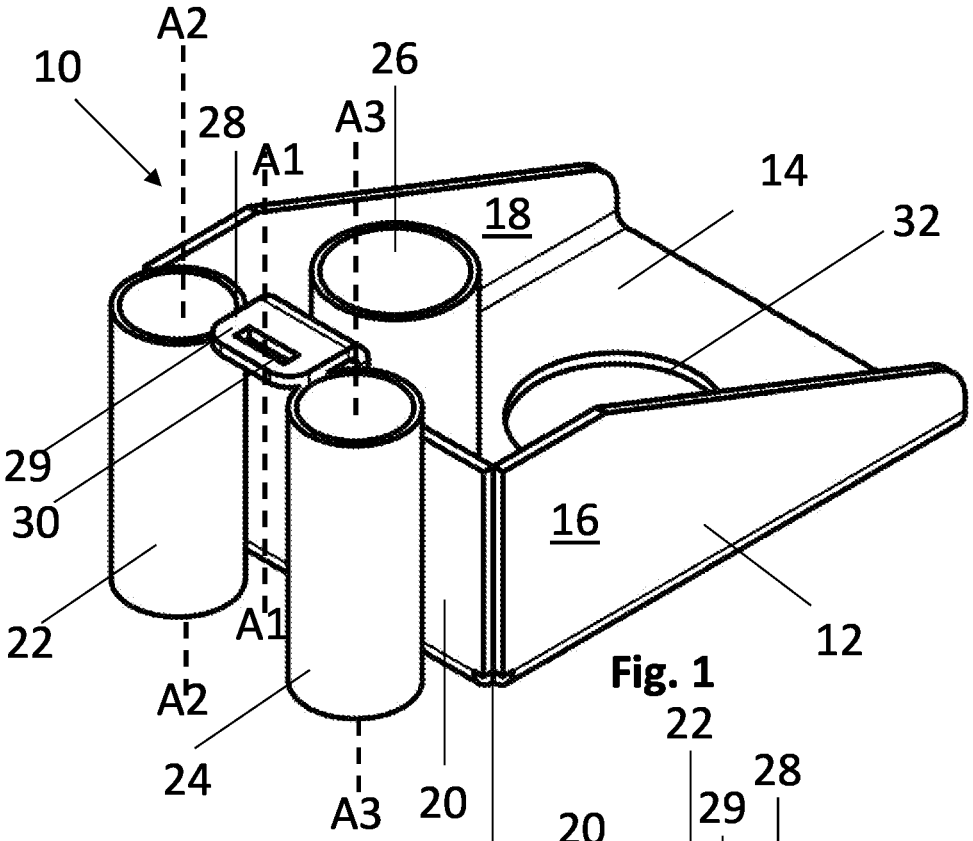
FIG. 1 is a perspective view of a fence bracket.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

With reference to FIGS. 1 to 9, a fence bracket 10 is disclosed for use as part of a fence assembly 1000. The fence bracket 10 is suitable for use with temporary fence panels 60A, 60B such as the fence panel produced by Heras™. However, the present fence bracket 10 may be employed with any suitable temporary or permanent fencing as required by the installer or their present need.

Figure 6:
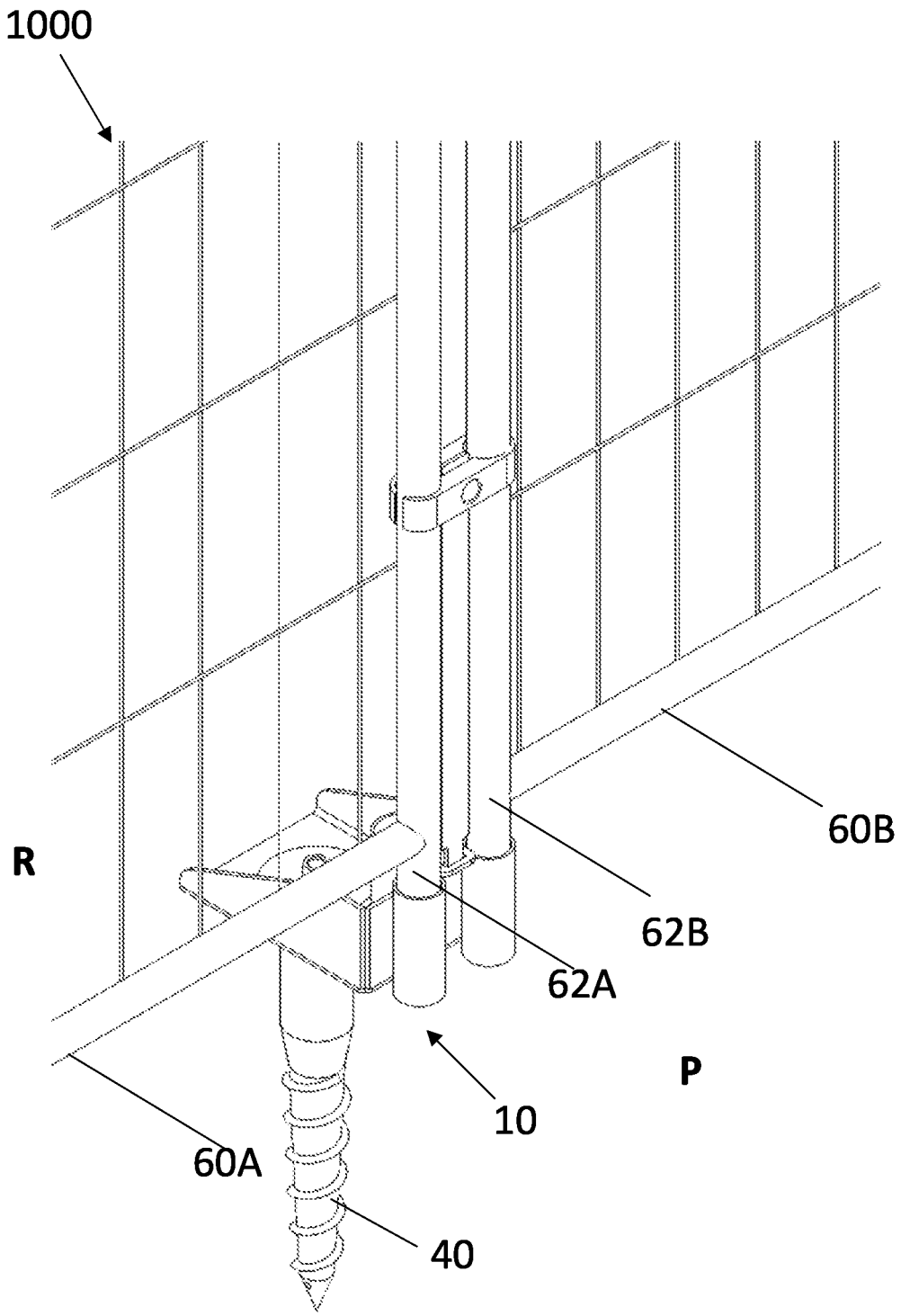
FIG. 6 is a perspective view from a "public" side of the fence assembly of FIG. 5.

The fence bracket 10 in use as part of a fence assembly 1000 defines a "public" side which is not fenced off or restricted and a "restricted" side in which the fencing assembly 1000 restricts public access to an area. The "public" side is denoted by the letter P and the "restricted" side is denoted by the letter R. These areas are shown in FIG. 6.

Figure 2:
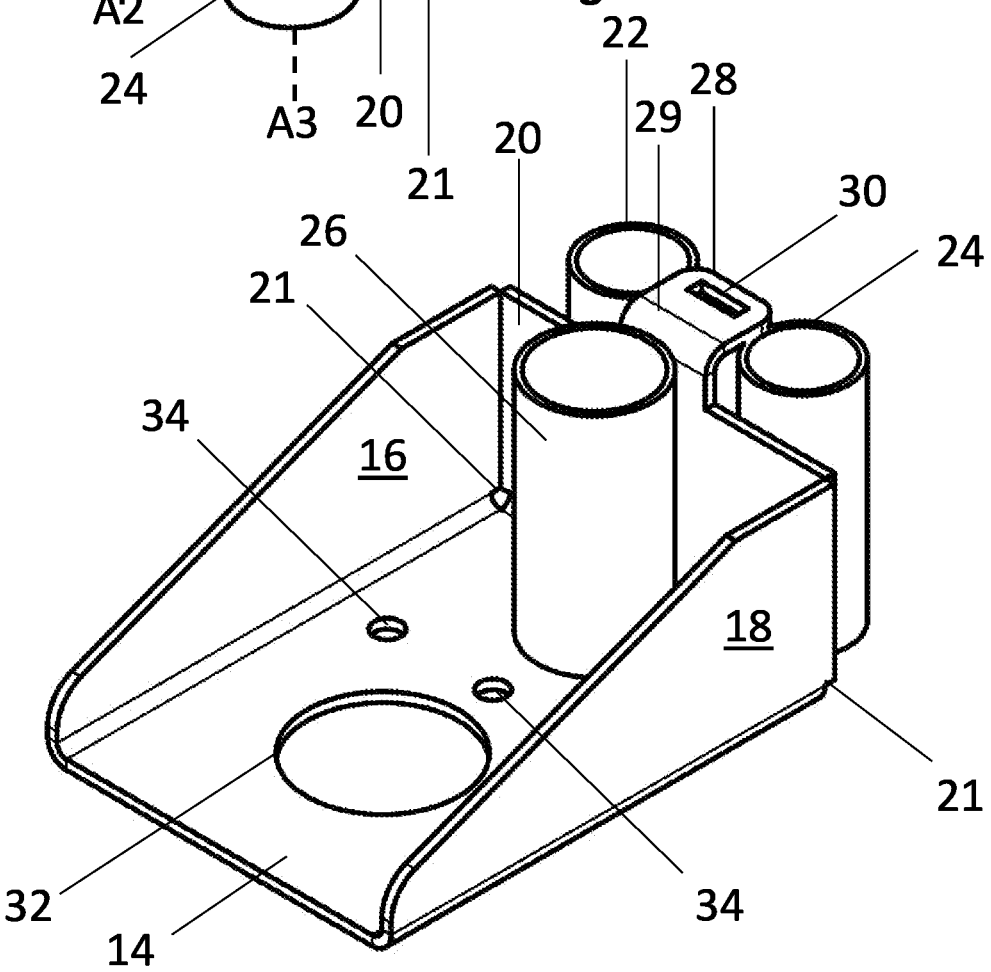
FIG. 2 is a second perspective view of the fence bracket of FIG. 1.
Figure 3:
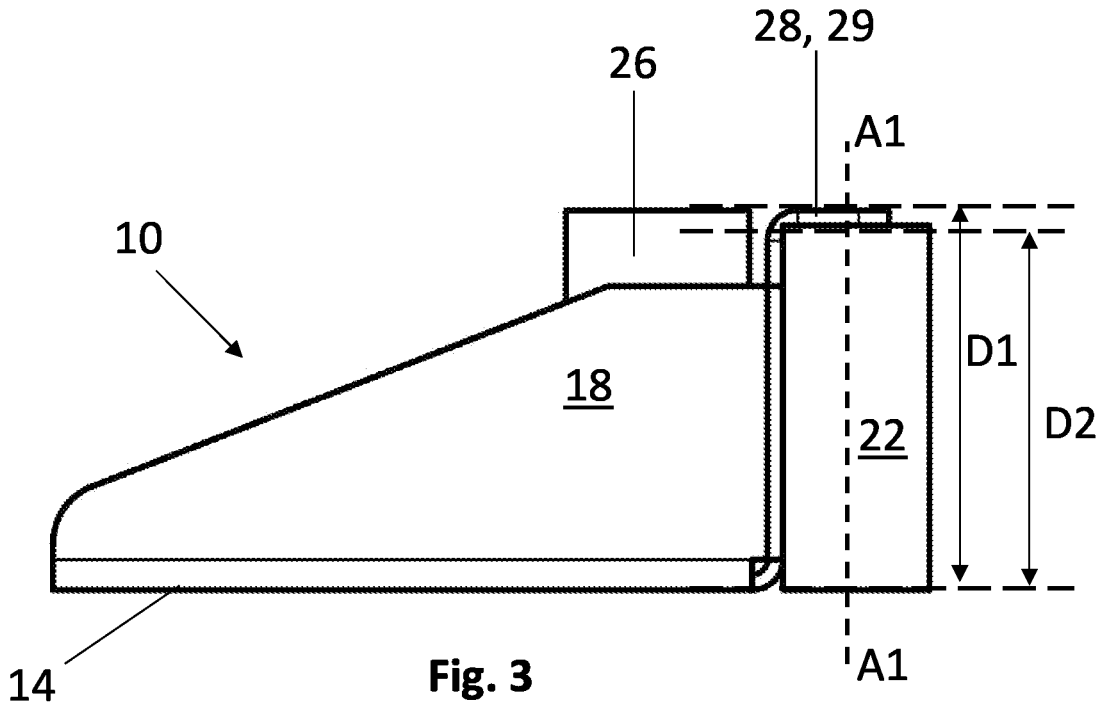
FIG. 3 is a side on view of the fence bracket of FIG. 1.

The fence bracket 10 is shown in FIG. 1. The fence bracket 10 comprises a body 12. The body 12 is made up of a base 14 and a front wall 20. The front wall 20 may be a substantially vertical region 20. The body 12 shown in FIG. 1 further has sidewalls 16 and 18. The sidewalls 16, 18 connect to the front wall 20 and provide structural reinforcement to the front wall 20. The sidewalls may taper towards the base 14 from a maximum height at or adjacent to the front wall 20 as shown in FIGS. 1-3. The fence bracket 10 is therefore arranged as a box section.

Vertical may be taken to mean "substantially vertical" or "approximately vertical" throughout. Similarly, perpendicular may be taken to mean "substantially perpendicular" or "approximately perpendicular" throughout. Similarly, co-planer may be taken to mean "substantially co-planer" or "approximately co-planer".

The front wall 20 is preferably a wall as shown in FIG. 1. The front wall 20 connects to the base 14 at the bottom of the front wall 20.

The body 12 may have a drainage hole 21 located at the intersection of the base 14, first side wall 16 and the front wall 20 as shown in FIGS. 1 and 2. The drainage hole permits rainwater or other fluid to drain out of the fence bracket 10 and not sit in the internal cavity of the body 12.

The body 12 may have a drainage hole 21 located at the intersection of the base 14, second side wall 18 and the front wall 20 as shown in FIG. 2. The drainage hole permits rainwater or other fluid to drain out of the fence bracket 10 and not sit in the internal cavity of the body 12.

Alternatively, the front wall 20 may be a strip or tab extending from the base. In such embodiments the body 12 may or may not comprise sidewalls 16, 18.

The front wall 20 has connected to it a first support 22 and optionally a second support 24. The embodiment shown in FIG. 1 has both a first and second support 22, 24. The first support 22 defines an axis A2. The second support defines an axis A3. The first and second supports 22, 24 are preferably tubes as shown in FIGS. 1 and 2. The tubes are sized to receive fence posts 62A, 62B of a temporary fence panels 60A, 60B (or gate panel post of a gate panel) within the inner diameter of the tube. The first and second supports 22, 24 are connected to the body 12 at the front wall 20, preferably such that they cannot be removed. In alternative embodiments, the first and second supports 22, 24 may be detached from the front wall 20 and body 12.

The first and second supports 22, 24 preferably extend such that the bottom of the first and second supports 22, 24 touch the ground in use.

Figure 5:
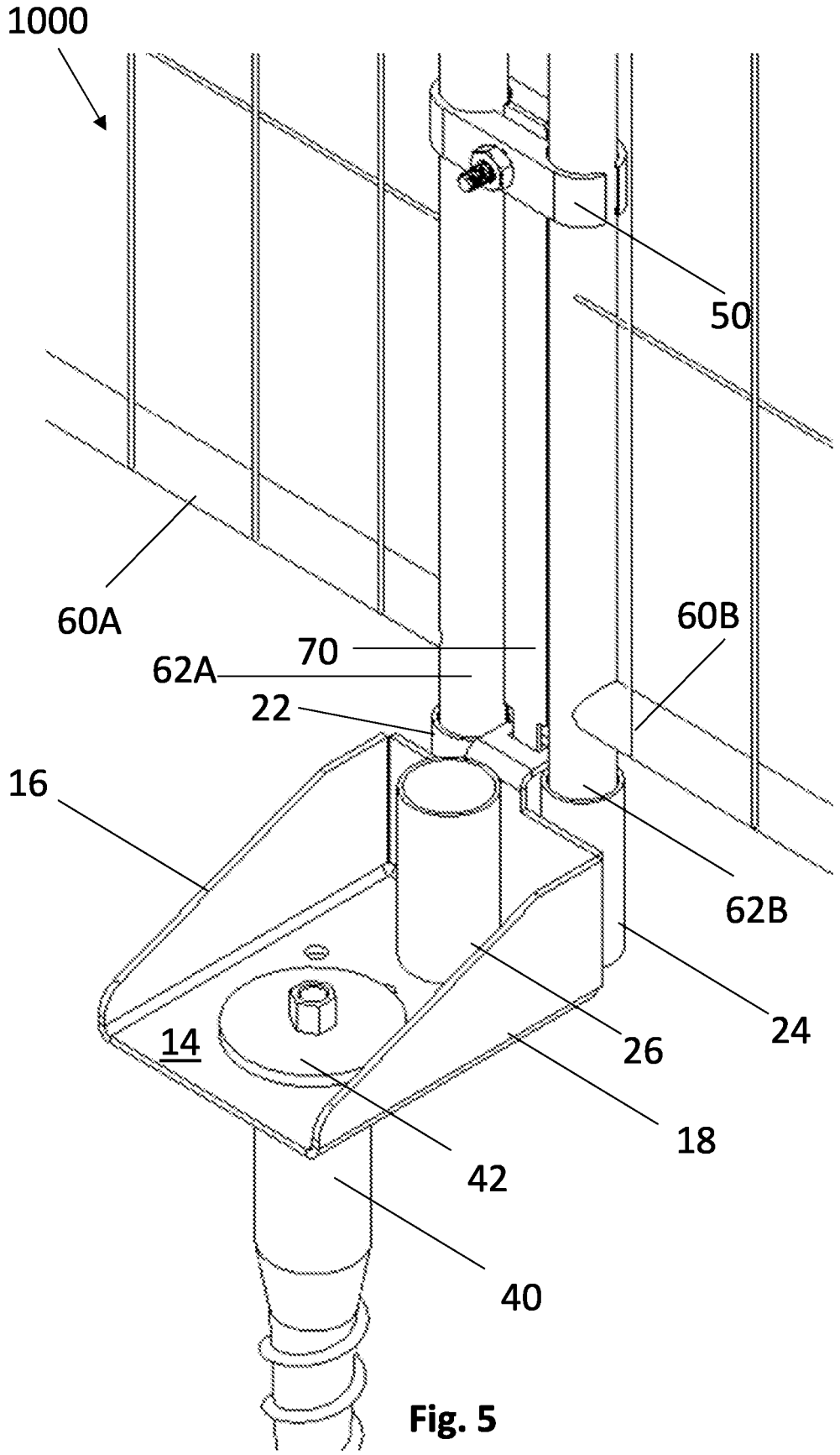
FIG. 5 is a perspective view from a "restricted" side of a fence bracket assembly incorporating a fence bracket system including the fence bracket of FIG. 1.

Alternatively, the first and second supports 22, 24 may not extend such that the bottom of the first and second supports 22, 24 touch the ground in use. In such an embodiment there is a distance D3 between the bottom of the first and second supports 22, 24 and the ground to enable the fastening of two fence posts together with a fastener 50 in use. The distance D3 may be the height of a fence panel joining bracket 50, an example of such a bracket 50 is shown in FIG. 5. The ability to lock the fence posts 62A, 62B adds additional security as the fence posts 62A, 62B are locked together using a fastener 50 which cannot be pulled out of the fence bracket 10. If someone were to try and pull the fastened fence posts 62A, 62B out of the fence bracket 10 the fastener 50 would abut the bottom of the first and second supports 22, 24 preventing the fence panels 60A, 60B from being lifted further.

Alternatively, the first and second supports 22, 24 may not be tubes but may be posts that a fence post 62A, 62B is placed upon.

As shown in FIGS. 1 and 2 the front wall 20 comprises an aperture 30. The aperture defines an axis A1. The aperture 30 is suitable for receiving an ancillary component 70 such as arm 70 shown in FIGS. 5-7. The arm may also be referred to as a locking strap 70. The aperture 30 is preferably configured to retain an aperture engaging portion 72 of the arm 70. The aperture 30 is therefore complementary to the aperture engaging portion 72.

The aperture 30 may be disposed on tab 28 as shown in FIGS. 1 and 2. Such a tab extends from the front wall 20. The tab 28 may extend vertically from the front wall 20. Alternatively, the tab 28 may extend perpendicularly from the front wall 20 into the "public" side of the fence bracket 10 (the side with the first and second fence post supports 22, 24) or conversely the tab 28 may extend perpendicularly from the vertical wall 20 into the "restricted" side of the fence bracket 10. Alternatively, multiple tabs 28 may be provided in two or more of the locations described to permit greater variability of use by the installer.

In the embodiment shown in FIG. 1, the tab 28 extends vertically from the front wall 20 and the tab further comprises a bent portion 29. The bent portion 29, as shown in FIGS. 1 and 2, is a region of the tab 28 that is substantially perpendicular from the front wall 20 and causes the aperture 30 to extend into the "public" side of the fence bracket 10. Alternatively, the bent portion 29 of tab 28 may extend into the "restricted" side of the fence bracket.

The tab 28 is preferably disposed, at a distance D1 from the ground, above the top surface of the first and second fence post supports 22, 24 as shown in FIG. 3. The top of the first and second fence post supports 22, 24 is at a distance of D2 from the ground as shown in FIG. 3. At the same time the tab 28 is located between the first and second supports 22, 24 when viewed from above as in FIG. 4 to permit fence posts 62A, 62B to enter the fence post supports 22, 24. A fence post 62A, 62B may be a fence panel post or a gate panel post.

Optionally the distance D1 may be greater still to permit the placing of a fastener 50 between the top of the first and second fence post supports 22, 24 and the bottom of the tab 28. In such a scenario the fence posts 62A, 62B received in the supports 22, 24 can be fastened together (using a fence panel joining bracket 50 or other fastener 50) below the tab 28. Fastening in this manner prevents the fence posts 62A, 62B being removed from the fence bracket 10 as lifting fence panel 60A, 60B causes the fastener 50 to abut the tab 28 preventing the fence panel 60A, 60B being lifted any further.

Figure 4:
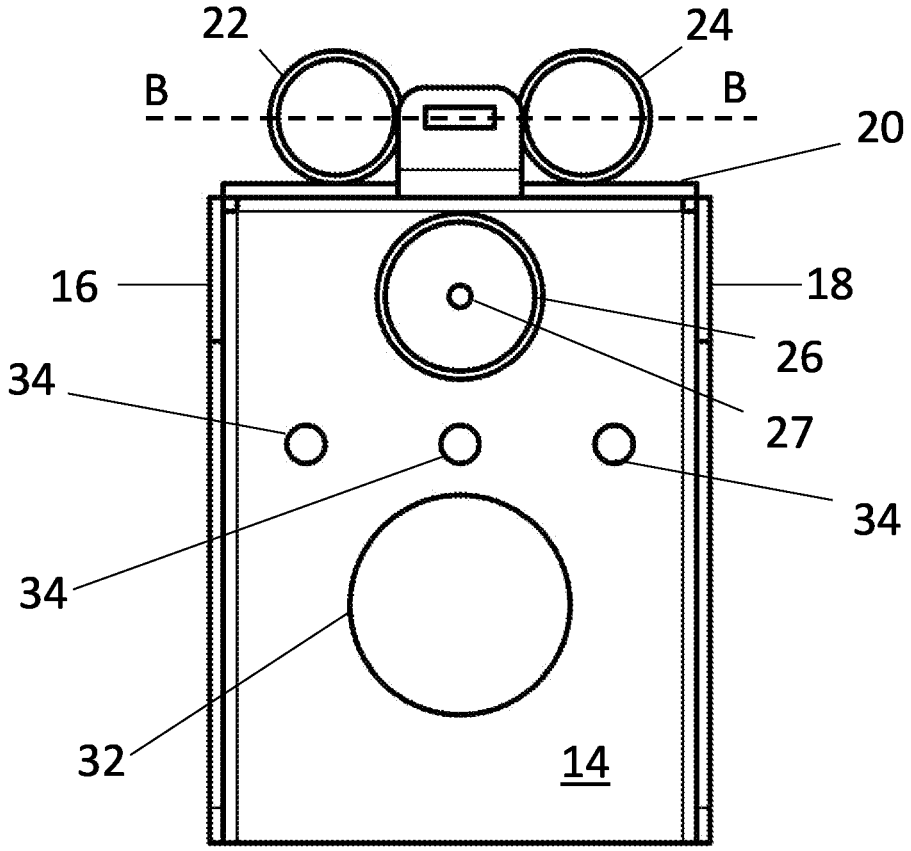
FIG. 4 is a plan view of the fence bracket of FIG. 1.

Preferably the axis A1 of the aperture 30 is coplanar with the axis A2 of the first fence post support 22 and coplanar with an axis A3 of the second fence post support 24. The three axis A1, A2, A3 thus sit substantially upon plane B as shown in FIG. 4.

Figure 7:
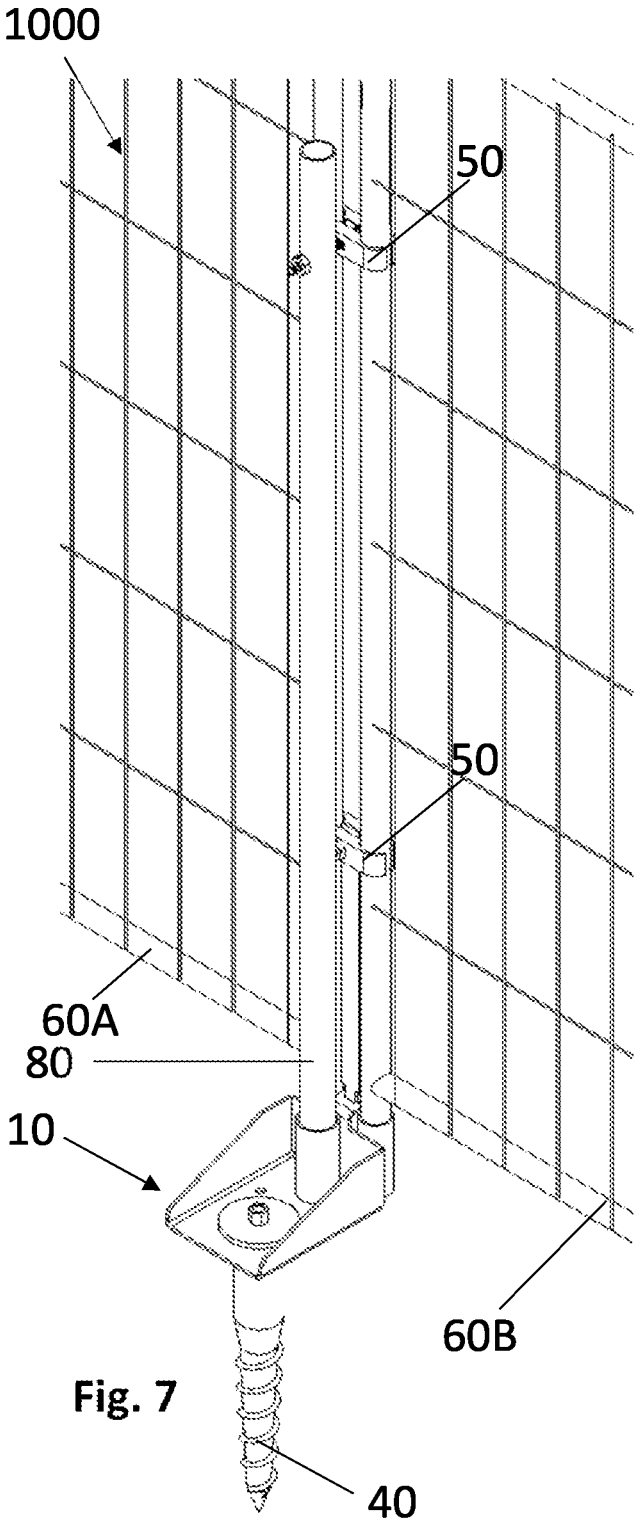
FIG. 7 shows a perspective view of an alternative fence assembly from the "restricted" side.

The base 14 of the fence bracket 10 has a portion 32 for receiving a ground penetrating member 40. The portion 32 is preferably a hole or aperture 30 which is complementary to a ground penetrating member 40 as shown in FIGS. 5-7. The aperture 30 is located on the "restricted" side of the fence bracket 10 such that it cannot be accessed from the "public" side when part of a fence assembly 1000 as shown in FIG. 6.

In one embodiment the ground penetrating member 40 in FIG. 5 is a ground screw 40 also known as a ground penetrating screw. Ground screws 40 are provided with a thread that can be driven into soft ground, such as earth. Ground screws 40 are made of steel and preferably a galvanised steel. Ground screws 40 may include a fixture to aid driving the ground screw 40 into the ground. An example fixture is a hexagonal drive nut as shown in Figure. Ground screws 40 are typically driven into soft ground. For example, using a petrol driven nut wrench in combination with the hexagonal drive nut. Ground screws 40 provide a more secure hold than tent pegs or ground stakes for example.

The ground screw 40 is received in the hole 32 in use. The ground screw 40 has a flanged region or flange 42. The flange 42 in use aids in spreading the pressure built up by screwing in the ground screw 40 into the ground across the base 14 of fence bracket 10. The spreading of the pressure across the area of the base 14 adjacent the hole 32 and covered by the flange 42 helps to ensure a more stable bracket 10 when used in a fence assembly 1000.

The body 12 may further comprise an ancillary support 26 connected to the base 14 and or front wall 20 as shown in FIG. 1. The ancillary support 26 shown in FIG. 1 is a length of tubing. The ancillary support 26 may be used to connect ancillary support components 120 to the fence bracket 10. An example ancillary support component 120 is the post 80 shown in FIG. 7. The ancillary support 26 is complementary to the ancillary support component 120. The ancillary support 26 may comprise means suitable for fixing the ancillary support component 120 into the ancillary support 26. For example, the means may be a bolt, screw, clamp or other similar fastening means to fix the ancillary support component 120 into the ancillary support 26.

The base 14 has a hole 27 which is a drainage hole. 27. The hole 27 is located within the ancillary support 26 as shown in FIG. 4. The hole 27 permits fluid such as water or rainfall to drain out of the ancillary support 26.

Preferably the base 14 does not extend past the "front" of the front wall 20 (the side facing the "public" side) and/or the first support 22 and/or the second support 24. The base 14 not extending past one or more of these components means that in use the base 14 does not extend onto the "public" side of the fence assembly 1000. Advantageously this means it is less easy to lever up the fence bracket 10 and thus fence assembly 1000 using a lever, crowbar of the like. A further advantage is that the resulting fence assembly 1000 can be closer to the true extent of the development area rather than being staggered back as with prior art systems. Further, the fence bracket 10 is less likely to be a tripping hazard in such a scenario.

The base 14 may further comprise a hole 34. The hole 34 is suitable for receiving an anchor bolt (also known as an expansion bolt). An anchor bolt may be inserted through hole 34 for securing the fence bracket 10 on hardstanding such as concrete or tarmacked surface. The hole 34 aligns with a hole in the hardstanding surface. The aligned holes then receive the anchor bolt. The anchor bolt is then actuated expanding into the hardstanding hole pulling the fence bracket 10 into closer contact with the hardstanding surface.

A number of holes 34 may be provided in the base. The number of holes 34 may be two or three or four or five or six or seven or eight or nine or ten. The number of holes 34 may be any number in the range two to ten or two to five. Preferably the number of holes 34 is three.

Where multiple holes 34 are provided on the base, they may be provided in a line as shown in FIG. 4. Alternatively, the holes 34 may be provided in any such suitable configuration, for example: where n holes 34 are present (where "n"

is the number of holes 34) the holes 34 may be arranged as the corners of an n-sided shape (regular or irregular) on the base 14.

For example, where three holes 34 are present the holes 34 could be provided in a triangular arrangement or a linear arrangement; where four holes 34 are present the holes could be provided in a rectangular or square arrangement, etc. . . . .

The hole(s) 34 may alternatively be used to receive a tent pole or stake. The tent pole or stake may be used in combination with a ground penetrating member 40 to fix the fence bracket in place on soft ground.

The hole 32 adapted to receive the ground penetrating member is larger in diameter that the hole(s) 34 adapted to receive the anchor bolts.

The fence bracket system 100 will now be described in more detail with reference to FIGS. 1 to 7. The fence bracket system 100 incorporates the fence bracket 10 as described above as well as one or more ancillary components 110 and/or one or more ancillary support components 120.

Figure 11:
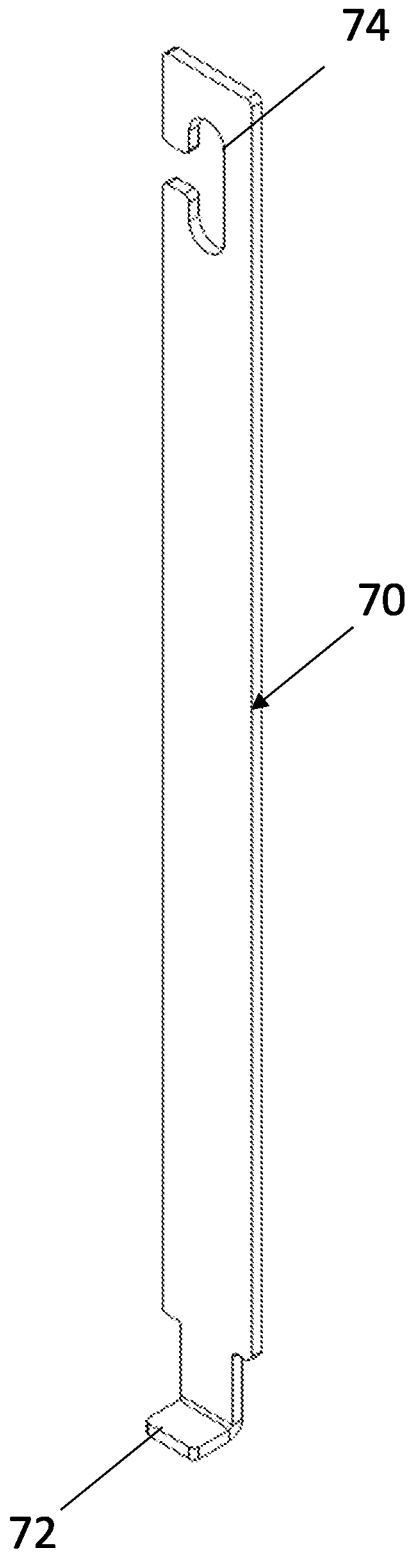
FIG. 11 shows a component of the fence bracket system of FIG. 5.

The ancillary component 110 may be one or more of an arm 70; or a fastener 50; or a levelling device. The ancillary support component 120 may be one or more of: a stabilizer; or an brace; or an access door; or a camera pole; or a solar light; or a flag pole; or any other suitable fixtures. The arm 70 (also known as a locking strap 70) is shown in FIG. 5 and FIG. 11 in a closer view. The arm 70 has an elongated body as shown in FIG. 5. The arm 70 comprises an aperture engaging portion 72 disposed at one end of the arm 70 configured to engage aperture 30 of the bracket 10. The arm engaging portion 72 is complementary to the aperture 30 of the region of front wall 20. As shown in FIG. 11 the arm engaging portion 72 is preferably a tab 72.

The arm has an arm aperture 74 disposed at a second end of the arm 70 as shown in FIG. 11. The arm aperture 74 is configured to receive a fastener 50 as shown in FIGS. 5 and 6. As shown in FIG. 5 the fastener 50 enables the fence panels 60A, 60B to be fastened together above the fence bracket 10. Raising the location of the fastener 50 from near the ground adjacent the fence bracket 10 reduces the need for an installer to bend down to fix the fence panel joining bracket 50 to the assembly 1000.

The fastener 50 is a fastening arrangement and preferably is a fence panel joining bracket 50. The fence panel joining bracket comprises a first bracket, a second bracket a bolt and a nut. The first and second brackets act together to clamp two fence panel post 62A, 62B between them as shown in FIG. 5.

The fence panel joining bracket 50 may be comprise an anti-tamper device to prevent unauthorised removal of the fence panel joining bracket 50. The anti-tamper device may be an anti-tamper screw or bolt for example.

The arm 70 may be installed into the fence bracket 10 from either the front or rear of the fence bracket 10.

The arm 70 may extend further than the example shown in FIG. 5. The arm 70 may extend to the top of the fence panel 60A such that the gap between fence panels 60A and 60B is completely covered by the arm 70. In such an embodiment the arm 70 may have multiple arm apertures 74 to engage multiple fasteners 50 to fasten fence panels 60A, 60B together with the fence bracket 10. An advantage of this longer arm 70 is that it reduces ease of access into the "restricted" area further. It also reduces the ability for tools to be slipped between the fence panel tubes which could be used to force the panels 60A, 60B apart.

Further, connections or apertures for fixing ancillary components may be provided on an arm 70. The arm 70 may provide connections for bracings, fixtures, stabilisers or other such fixtures.

The stabilizer may be an apparatus which provides stability to the fence bracket system 100 and as such reduces the effect of sideloading or wind on the fence bracket system 100.

Figure 10:
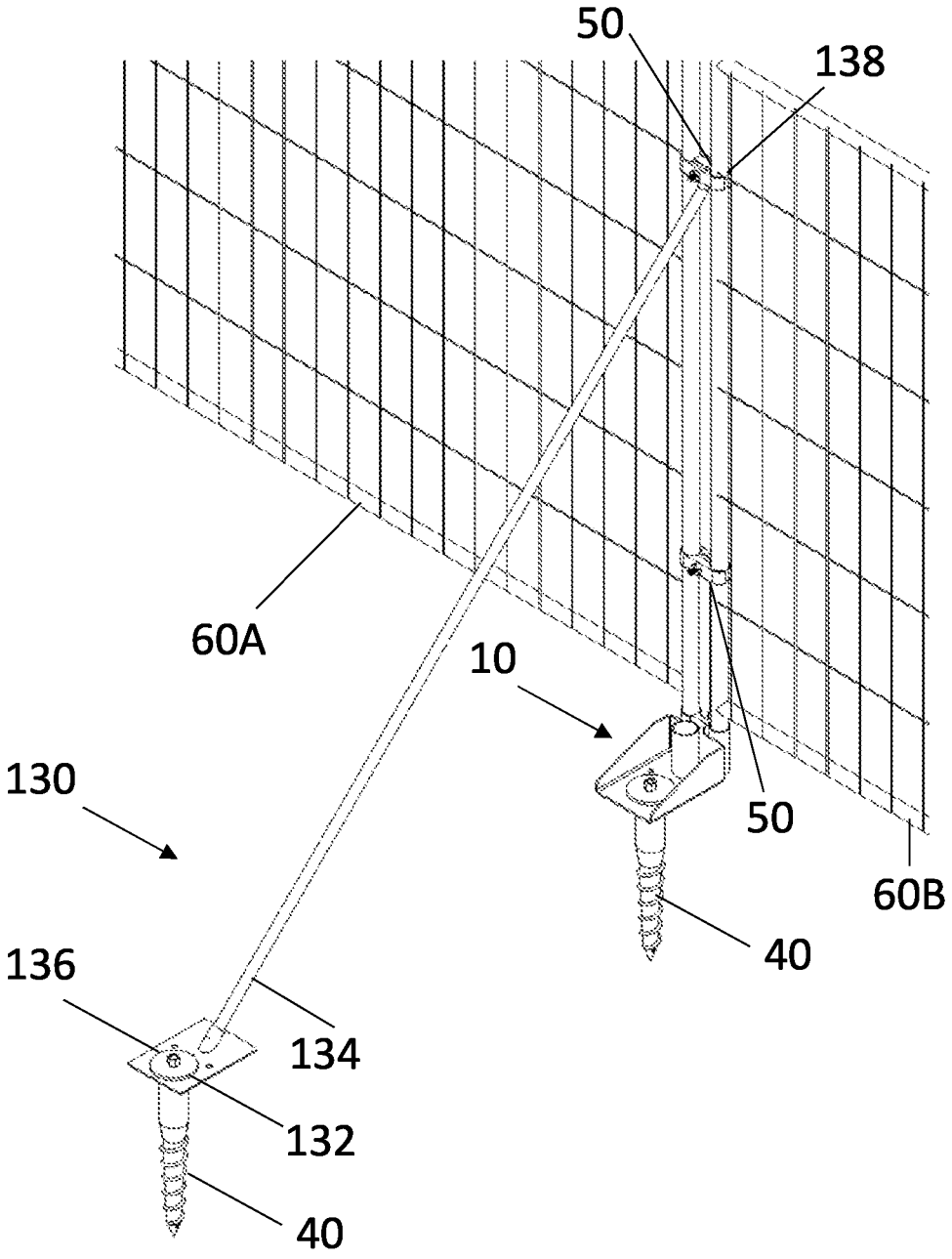
FIG. 10 shows a perspective view of an alternative fence assembly from the "restricted" side.

The brace 130 may be an apparatus which provides stability to the fence bracket system 100 and as such reduces the effect of sideloading or wind on the fence bracket system 100. The brace 130 is shown in FIG. 10. The brace 130 comprises a brace plate 132 and a brace pole 134. The brace plate 132 has a brace pole support 136. The brace pole support 134 may be an angled piece of tubing as shown in FIG. 10 that the brace pole 134 is received within. The end of the brace pole 136 not connected to the support has a fixture 138 for fixing the brace poll 134 to the fence panel joining bracket 50. The fixture 138 may be a tab or aperture or flattened portion of the brace pole 134 with an aperture to be received in a fence panel joining bracket 50.

According to a further aspect a kit of parts is provided. The kit of parts comprises the fence bracket system 100 described above. Optionally the kit of parts may comprise at least one fence panel 60A or at least two fence panels 60A, 60B, optionally the kit of parts may comprise a gate. According to a further aspect a fence assembly 1000 is described. The fence assembly 1000 comprises the fence bracket system 100 described above and at least one fence panel 60A, 60B. Optionally the fence assembly 1000 may comprise at least two fence panels 60A, 60B, optionally the assembly 1000 may comprise a gate.

Optionally one of the fence panels 60A, 60B may be exchanged for a gate with a gate panel post. The gate may be retained in the first or second support 22, 24 and may be made to pivot in the respective support.

According to another aspect a method of manufacturing a fence bracket 10 is described.

Figure 12:
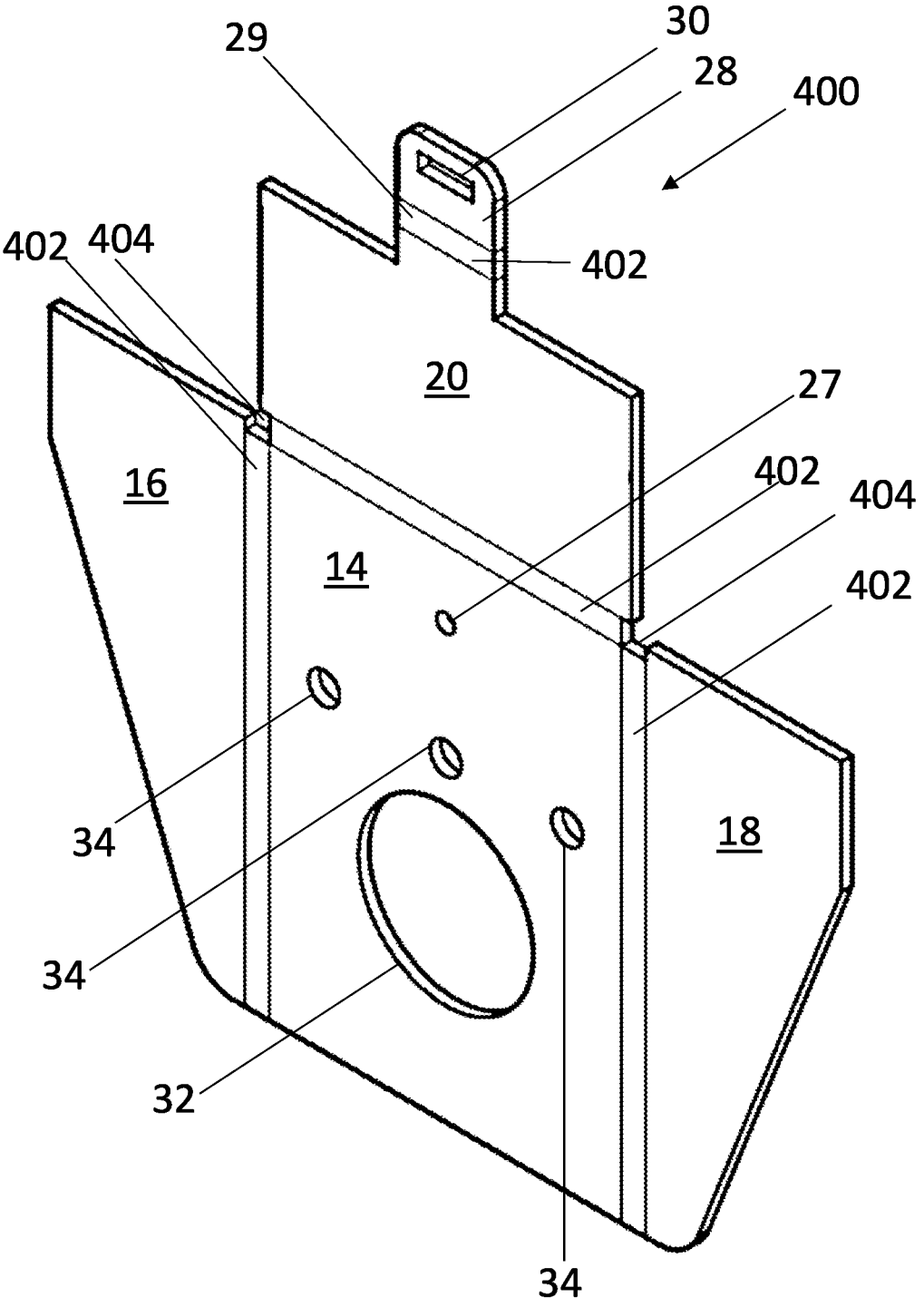
FIG. 12 shows a cut shape of material forming a body.

The method of manufacturing a fence bracket 10 comprises cutting a shape from a material sheet. The cut shape 400 is shown in FIG. 12. Preferably the material is a metal. Preferably the shape is cut from a flat metal sheet. The cutting may be achieved by means of laser cutting. Alternatively, the cutting may be done via other methods such as using a cutting torch or water jet cutting. The aperture 30 and holes 27, 32, 34 are also cut into the material sheet. The cut shape is then folded to form the body 12. Folds are made at folding regions 402 indicated in FIG. 12. The body is made up of a base 14, a font wall 20 and a first side wall 16 and second side wall 18. The front wall 20 is connected to the first and second side walls 16, 18; and a first support 22 is connected to the body 12. Optionally where a second support 24 is required a second support may be also connected to the body 12.

The front wall 20 is connected by a weld to the first and second side walls 16, 18. A portion of the wall is left unwelded towards the base 14 to form a hole 21 suitable for drainage. A notch or scallop 404 may optionally be provided. The notch 404 forms at least a portion of the hole 21 when the front wall 20 and one of the side walls 16 or 18 are folded together. The notch 404 provides a greater area hole 21.

The first and second supports 22, 24 are welded to the body 12.

The sidewalls 16, 18 are welded to the front wall 20. The weld is made along the length of the front wall except at the point where the sidewalls meet both the base 14 and the front wall 20. At such a point no weld is made and a hole 21 is left to allow drainage out from the body 12.

The method further comprises forming the tab 28 with the aperture 30 disposed thereon.

The fence bracket 10 is manufactured from metal. The metal may be steel. The steel may be a mild steel.

The fence bracket 10 may be surface finished. For example, the fence bracket 10 may have a powder coating applied. The powder coating assists in reducing risk of corrosion and at the same time can be in a bright colour to indicate to the public that a hazard may be present.

Figure 8:
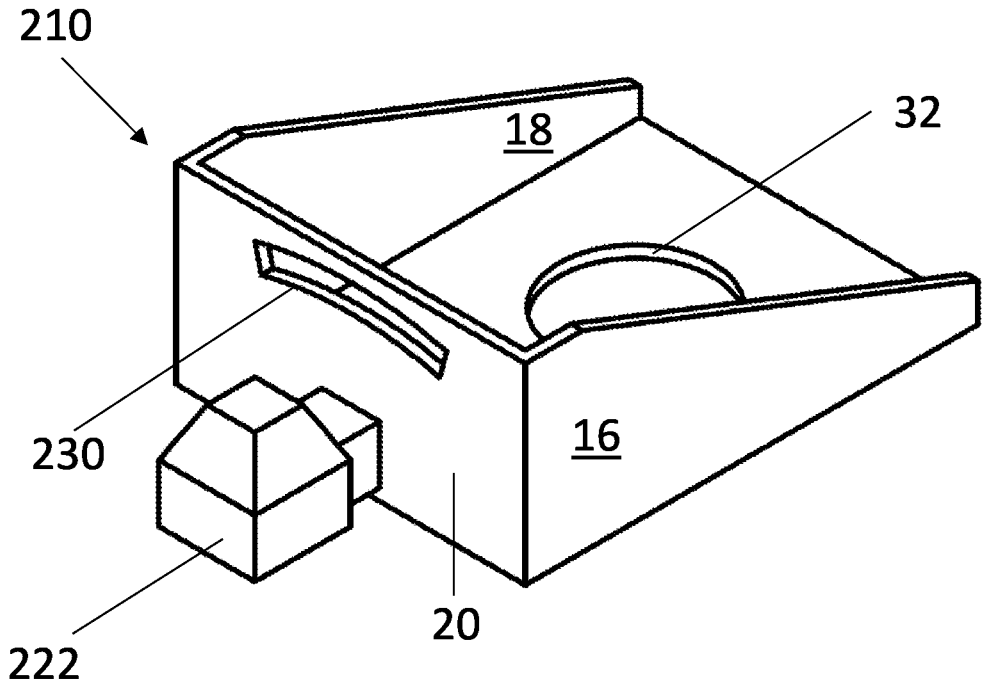
FIG. 8 shows a perspective view of a further fence bracket.

According to an alternative embodiment of the bracket, an alternative fence bracket 210 is described. The fence bracket 210 is shown in FIG. 8. The fence bracket 210 is similar to the fence bracket 10 described above and therefore features in common are indicated with the same reference numbers. Alternative features are designated numbers in the two-hundreds. The fence bracket 210 may be used as part of any of the previous aspects.

The fence bracket 210 has a support 222 extending from the front wall 20 of the body 12. The support 222 is a fence post support. The support 222 is shaped as shown in FIG. 8, that is a box with a substantially square-pyramidal top. The shape is complementary to a square (or rectangular) fence post. In use a square fence post sits onto of the support 222. An example of such a fencing system is the Fencesafe Temporary & Dulok fencing system using rigid mesh panels which this fence bracket 210 may be used with.

The fence bracket 210 has an aperture 230 disposed in the front wall 20 of the body 12. The aperture 230 is disposed above the fence post support 222. The aperture 230 is suitable to receive an ancillary component 110. The ancillary component 110 may be one of those described above. Preferably the ancillary component 110 is an adjustable levelling bracket to aid the installation of the fence assembly. For example, the levelling bracket may be a Fencesafe levelling tool. The levelling tool may receive the fence post such that fence post is held at two points on the fence bracket 210 (the support 222 and levelling tool).

The fence bracket 210 may have other features in common with the fence bracket 10 described above. The fence bracket 210 for example may have least one hole 34 suitable for receiving an anchor bolt for fixing the fence bracket 10 to hardstanding or hard ground. The fence bracket 210 may also have for example a portion 32 in the base 14 suitable for receiving a ground penetrating member 40 for fixing the fence bracket 10 to soft ground.

Figure 9:
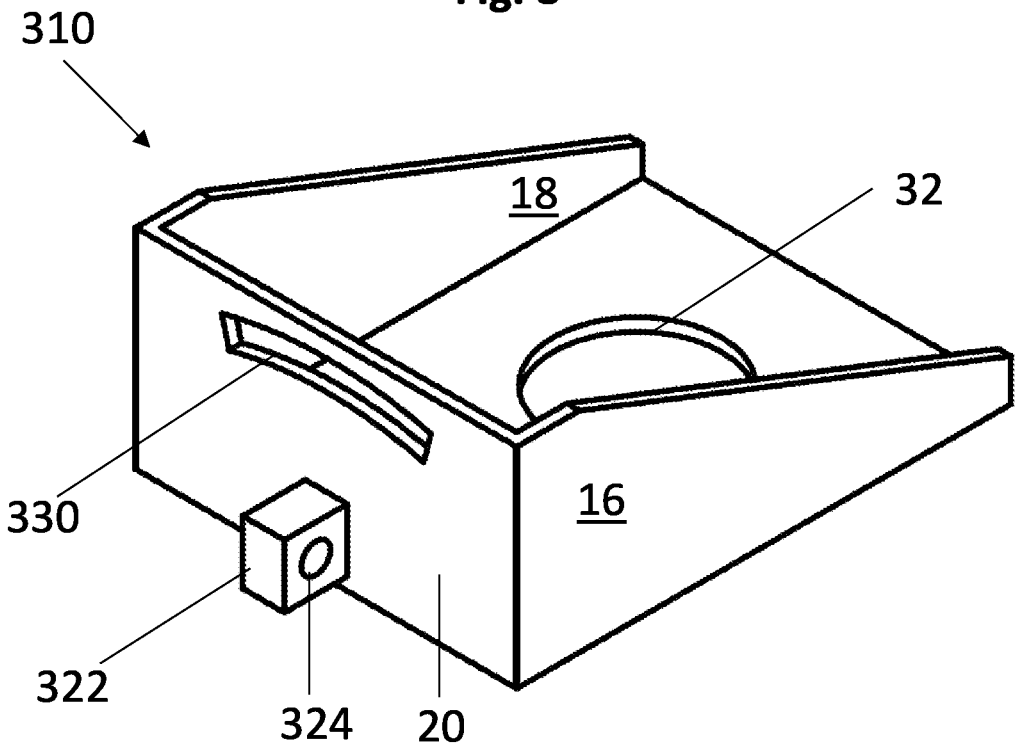
FIG. 9 shows a perspective view of a further fence bracket.

According to another embodiment of the fence bracket, an alternative fence bracket 310 is described. The fence bracket 310 is shown in FIG. 9. The fence bracket 310 is similar to the fence bracket 210 described above except that an alternative support 322 is provided on the front face 20. The fence bracket 310 may be used as part of any of the previous aspects.

The support 322 has a hole 324. The support 322 and hole 324 are used to connect the fence bracket 310 to a fence post. The support 322 and hole 324 may connect to a further bracket which holds the post.

While various embodiments of devices, systems, and methods have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

NO. FEATURE

A1 axis
A2 axis
A3 axis
B plane
D1 distance
D2 distance
D3 distance
P "public" side
R "restricted" side
10 bracket
12 body
14 base
16 side wall
18 side wall
20 front wall
21 hole
22 support
24 support
26 ancillary support
27 hole
28 tab
29 bent portion
30 aperture
32 hole
34 hole
40 ground penetrating member
42 flange
50 fence panel joining bracket
60A fence panel
60B fence panel
62A fence panel post
62B fence panel post
70 ancillary component; arm
72 aperture engaging portion
74 arm aperture
80 post
100 fence bracket system
110 ancillary component
120 ancillary support component
130 brace
132 brace plate
134 brace pole
136 brace pole support
210 fence bracket
222 support
230 aperture
310 fence bracket
322 support
324 hole
330 aperture
400 shape

402 folding region
404 notch, scallop
1000 fence assembly

The invention claimed is:

1. A fence bracket (10) suitable for use with a fence post, the fence bracket comprising:
a body (12) having a base (14), a front wall (20), a first side wall (16) and a second side wall (18); and
a support (22);
wherein the support (22) is provided on the front wall (20); and
the support (22) is configured to connect to a fence post; and
wherein the front wall (20) has a region comprising an aperture (30) suitable for receiving an ancillary component (70), wherein the region comprises a tab (28) extending from the front wall (20), and wherein a portion (29) of the tab (28) is bent such that the portion (29) extends substantially perpendicularly from the front wall (20).

2. The fence bracket (10) of claim 1 wherein the aperture (30) is located on the tab (28).

3. The fence bracket (10) of claim 1, wherein the base (14) further comprises a portion (32) suitable for receiving a ground penetrating member (40).

4. The fence bracket (10) of claim 1 wherein the body (12) further comprises an ancillary support (26) connected to the base (14) and/or front wall (20); wherein the ancillary support (26) is suitable to receive an ancillary support component.

5. The fence bracket (10) of claim 1 wherein the base (14) further comprises at least one hole (34) suitable for receiving an anchor bolt for fixing the fence bracket (10) to hardstanding or hard ground.

6. The fence bracket (10) of claim 1, wherein the fence bracket (10) further comprises a second support (24) provided on the front wall (20) and wherein the second support (24) is configured to connect to a fence post.

7. The fence bracket (10) of claim 6 wherein the aperture (30) has an axis (A1) that is coplanar with an axis (A2) of the first fence support (22) and coplanar with an axis (A3) of the second fence support (24)).

8. The fence bracket (10) of claim 6, wherein the first and second supports (22, 24) are tubes suitable for receiving a fence post.

9. A fence bracket system (100) comprising:
a fence bracket (10) comprising:
a body (12) having a base (14), a front wall (20), a first side wall (16) and a second side wall (18); and
a support (22);
wherein the support (22) is provided on the front wall (20); and
the support (22) is configured to connect to a fence post; and
wherein the front wall (20) has a region comprising an aperture (30) suitable for receiving an ancillary component (70); and
further comprising at least one ancillary component (110), wherein the at least one ancillary component (110) is an arm (70) and wherein the arm (70) comprises an aperture engaging portion (72) disposed at one end of said arm (70) configured to removably engage aperture (30) of the fence bracket (10), wherein the arm (70) further comprises an arm aperture (74) disposed at a second end of said arm (70) suitable for receiving a fastener (50).

10. The fence bracket system (100) of claim 9 wherein the at least one ancillary component (110) is at least one:
an arm (70); and/or
a fastener (50) and/or
a levelling device.

11. The fence bracket system (100) of claim 9 wherein the fence bracket system (100) further comprises an ancillary support component (120); wherein the ancillary support component (120) is one of:
a stabilizer; or
a brace; or
a camera pole; or
a solar light; or
a flag pole; or
a fixture.

12. The fence bracket system (100) of claim 9 wherein the at least one ancillary component (110) further comprises a fastener (50).

13. A fence bracket (10) suitable for use with a fence post, the fence bracket comprising:
a body (12) having a base (14), a front wall (20), a first side wall (16) and a second side wall (18); and
a support (22);
wherein the support (22) is provided on the front wall (20); and
the support (22) is configured to connect to a fence post; and
wherein the front wall (20) has a region comprising an aperture (30) suitable for receiving an ancillary component (70);
wherein the fence bracket (10) further comprises a second support (24) provided on the front wall (20) and wherein the second support (24) is configured to connect to a fence post; and
wherein the aperture (30) has an axis (A1) that is coplanar with an axis (A2) of the first fence support (22) and coplanar with an axis (A3) of the second fence support (24)).

14. The fence bracket (10) of claim 13 wherein the region comprises a tab (28) extending from the front wall (20).

15. The fence bracket (10) of claim 14 wherein the aperture (30) is located on the tab (28).

16. The fence bracket (10) of claim 13, wherein the base (14) further comprises a portion (32) suitable for receiving a ground penetrating member (40).

17. The fence bracket (10) of claim 13 wherein the body (12) further comprises an ancillary support (26) connected to the base (14) and/or front wall (20); wherein the ancillary support (26) is suitable to receive an ancillary support component.

18. The fence bracket (10) of claim 13 wherein the base (14) further comprises at least one hole (34) suitable for receiving an anchor bolt for fixing the fence bracket (10) to hardstanding or hard ground.

19. The fence bracket (10) of claim 13, wherein the first and second supports (22, 24) are tubes suitable for receiving a fence post.

* * * * *